United States Patent [19]

Young et al.

[11] 4,392,128

[45] * Jul. 5, 1983

[54] SEWAGE BACK-UP ALARM

[76] Inventors: Jack W. Young, 5510 E. 20th St., Tucson, Ariz. 85711; Alvin G. Krill, 6026 S. Morris Blvd., Tucson, Ariz. 85706

[ * ] Notice: The portion of the term of this patent subsequent to Apr. 14, 1998, has been disclaimed.

[21] Appl. No.: 195,323

[22] Filed: Oct. 9, 1980

[51] Int. Cl.[3] ..... G08B 21/00

[52] U.S. Cl. ..... 340/616; 137/557; 137/558; 340/620

[58] Field of Search ..... 340/616, 620, 604; 73/304 R, 304 C; 137/505.11, 527.6, 236 R, 467, 557, 558

[56] References Cited

U.S. PATENT DOCUMENTS

| | | | |
|---|---|---|---|
| 3,311,722 | 3/1967 | Hammerschmidt et al. | 340/604 X |
| 3,399,399 | 8/1968 | Apfelbaum | 340/620 X |
| 3,757,316 | 9/1973 | Fiorenzo | 340/620 X |
| 3,844,310 | 10/1974 | Brindisi | 137/467 X |
| 4,015,624 | 4/1977 | Wanstreet et al. | 137/467 X |
| 4,261,386 | 4/1981 | Young | 137/236 R X |

*Primary Examiner*—John W. Caldwell, Sr.
*Assistant Examiner*—Daniel Myer
*Attorney, Agent, or Firm*—Cahill, Sutton & Thomas

[57] ABSTRACT

A sewer back-up alarm apparatus for placement in an existing sewer line connecting a residence to a sewage collection system, the alarm apparatus including a connection element connected into a sewer line, an adaptor attached to the connection element, a cap attached in air-tight and water-proof relationship to the adaptor, the adaptor also having an O-ring for sealing the cap to the adaptor, whereby backed up sewage in the sewer pipe forcibly ejects the cap from the adaptor and permits the backed up sewage to flow onto the ground, rather than into the residence; the back-up alarm system also includes first and second electrical conductors extending into the interior of the connection element for electrically contacting backed up sewage to produce reduced electrical resistance between the first and second conductors. An alarm circuit generates an alarm signal in response to a reduced resistance to actuate an audible buzzer.

3 Claims, 5 Drawing Figures

FIG. 1
(PRIOR ART)
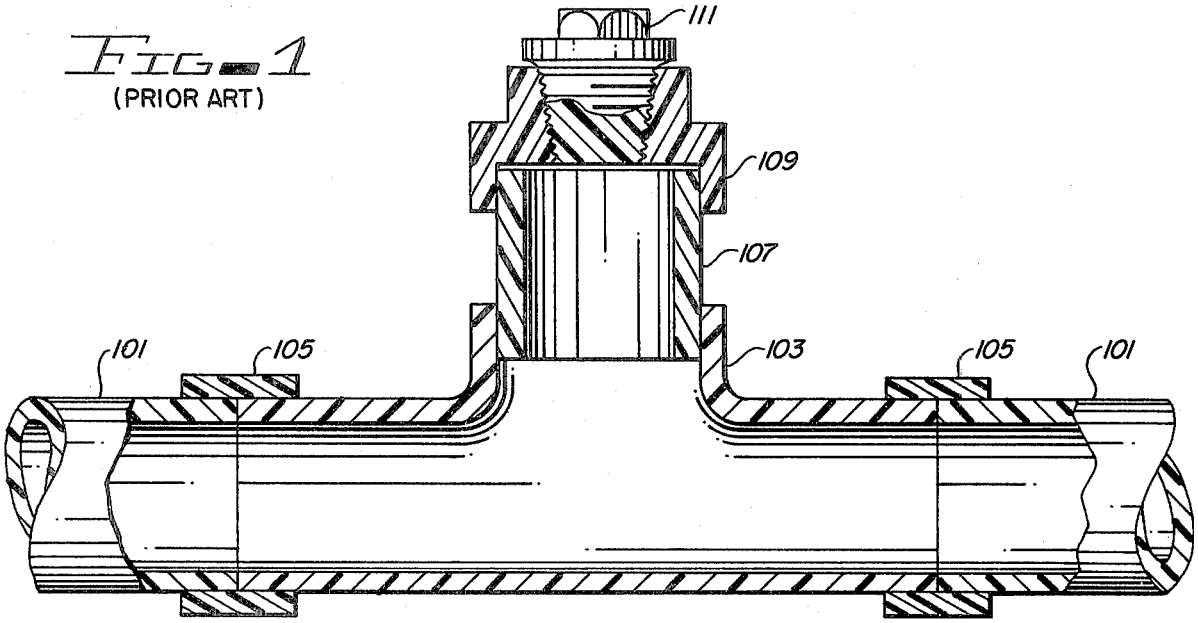
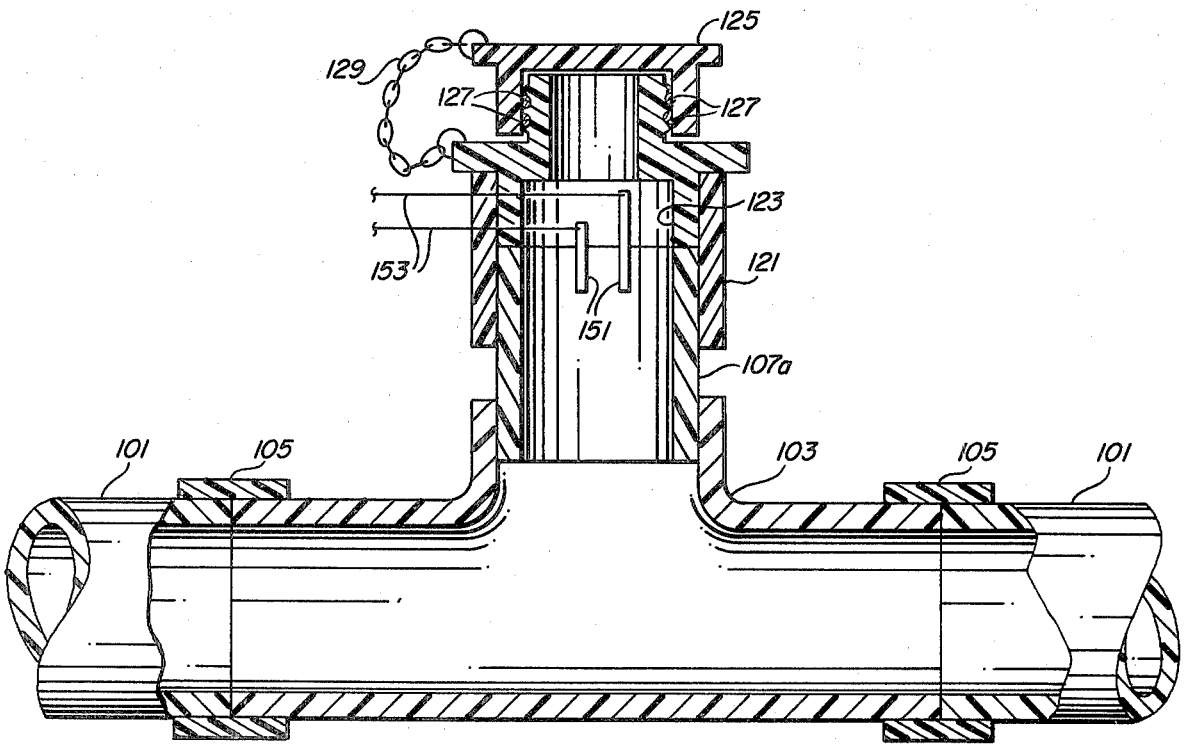
FIG. 2

SEWAGE BACK-UP ALARM

BACKGROUND OF THE INVENTION

In the installation of sewer pipes connecting residence or other commercial buildings with the central sewage system, such as a city sewer line or, for that matter, septic tanks, problems will develop in the sewer line, which are exhibited by the sewer line becoming filled with sewage and waste water. These problems may be caused by the central sewer system stopping up and thereby backing into the sewer pipe leading between the residence and the sewer system, or, by the sewer pipe becoming clogged between the residence and the central collection system. In these cases, it is common for the sewage to fill the pipes back into the residence, and to leak out on the floors of the residence, providing an undesirable situation.

It is common practice in plumbing construction to locate between the residence and the central sewage collection point a "T" section in the sewer pipe, and to install in that "T" section or pipe connected thereto, a sealed plug. Then, access through this sealed plug can be had for such things as removing debris and other materials which may clog the sewer line. As a rule, this access means is buried in the ground between the residence and the central system and thus, not readily accessible. This access means also suffers from the deficiency that while it does provide access into the sewer pipe, it does not really alleviate the damage caused by the problem it seeks to repair. The location of the access means in the sewer pipe does not prevent the sewer sysem from over-flowing nor does it have any features giving alarm. It merely helps remedy the problem once it has been developed.

It is obvious then, there is a need for a device which provides all of the features of the present access system, but with the additional feature that means are provided to give warning of the backing up sewage and water which otherwise would be flooding the interior of the premises where the sewer pipe ultimately connects.

SUMMARY OF THE INVENTION

Applicant's invention provides a device whereby a present existing access means in the sewer pipe between the residence or other facility and the central sewage system may be modified for giving alarm of sewage that backs up, or the device may be inserted into a sewer line not having a prior existing access means, which device then provides for giving the alarm of backing up sewage and means by which access is provided to remedy the problem.

More specifically, means are provided to communicate with the interior of the sewer pipe through a top cap located above ground, the top cap in an air and water-tight configuration with the sewer pipe, in order that backing up sewage will be so indicated as well as forcibly ejecting the top cap and bleed off before the interior of the residence becomes flooded. Means are also provided by a connecting adapter for containing the air and water-sealing means, namely by Neoprine O-rings engaging the cap.

The cap, which is nominally placed above ground, fits snugly over the adapter connecting the sewer pipe "T" section and is forced off by the pressure of the water or sewage backing up in the sewer pipe.

Additionally, means are provided by which the occupant of the residence is informed of when the sewage is in the process of overflowig the sewer line, said means comprising two electrical strips interiorly of the connecting adapter where when water and sewage rises sufficiently to cover the surface area between the two electrical strips, a circuit is completed which sounds a buzzer alarm.

It is the object therefore, to provide a means to prevent sewage flooding due to backed up sewers.

It is a further object of the present invention to provide an air-tight and water-tight means connective to a sewer line which will permit the exit of sewage in a backed up sewer line.

It is still a further object of the subject invention to provide means to bleed off backed up sewage in a sewer pipe.

It is still a further object of the present invention to provide means by which indication is given the resident occupant of sewage backing up in the sewer pipe.

BRIEF DESCRIPTION OF THE DRAWINGS

FIG. 1 is a cross-sectional view of the prior art showing an access plug in a sewer line.

FIG. 2 is a cross-sectional view of the subject invention in place in a sewer line.

DETAILED DESCRIPTION OF PREFERRED EMBODIMENT

Figure 3:
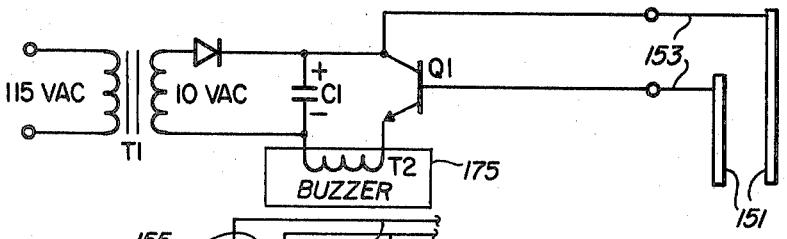
FIG. 3 is an electrical schematic diagram of the sewage level sensing apparatus.

Referring to FIG. 1, the prior art illustrating access valves or plugs which have been installed in the sewer line is shown in a cross-sectional view. Generally these access valves are located exterior to the house and in the sewer piping which runs from the house to the central street sewer line or septic tank. By this means, entrance into the sewer pipeline is afforded. Shown in cross-section is a section of the sewer pipe 101, normally four-inch sewer pipe, which is installed a "T" section 103. This "T" section 103 is secured in place in a water-tight fashion by means of overlapping sleeves 105 to which are applied the customary plastic pipe adhesive. Set into the "T" section 103 shank portion is pipe 107, nominally also a four-inch pipe. Atop the short length of pipe 107 is an adapter 109, generally a four-inch to four-inch adapter, one end of which encompasses the end of pipe 107 with the other end having converging threads screwed therein to receive plug 111, also a four-inch plug. All sleeve type connections shown in FIG. 1 have been air tight by the application of appropriate glues or adhesives. The plug is threaded into the adapter and a total air-tight seal is afforded thereby.

As had been earlier discussed, this type of prior art arrangement does not provide a means to prevent back up of sewage and water into the house in the event that the sewer pipe is clogged between the access mechanism shown in FIG. 1 and the street sewer system, or for that matter, if the street sewer system should back up. Also, as had been indicated earlier, in general construction, the access mechanism shown in FIG. 1 is buried in the yard of the home and thereby prevents access until it is uncovered. The need for an alarm therefore is obvious.

Applicant's invention, a cross-sectional view of which is shown in FIG. 2, is designed to give warning of this problem. Referring now to FIG. 2, the identical plastic sewer pipe 101 is illustrated as well as plastic "T" section 103. Additionally sleeve 105 is shown connecting "T" section 103 to sewer pipe 101 in a water-tight configuration, and plastic pipe 107 is also illustrated, which has been modified and termed 107*a*. It is anticipated that the applicant's relief valve, which permits sewage to rise in the access means to accomplish the alarm, will be a modification in part, in many cases, of present existing access means, and this is what has been illustrated in FIG. 2. Of course, the invention is not restricted to this use, and it may be used in new construction.

Pipe 107 has been cut off at or near former adapter 109, to form pipe 107*a* and the adapter 109 has been removed, together with plug 111. Newly added plastic coupling 121 is affixed to pipe 107*a*, the purpose of the coupling to extend the applicant's invention above the ground level over the area in which sewer pipe 101 is buried. To the top of coupling 121 is added new plastic adapter 123, one end of which is encompassed by the cylinder wall of coupling 121, and, the other end of which is encompassed by new plastic cap 125. Between the inside cylindrical wall of cap 125 and the outside cylindrical wall of adapter 123 are a plurality of O-rings 127 which provide an air-tight fit of cap 125 over adapter 123. O-rings 127 are set in annular grooves cut in the outside periphery of the upper cylindrical wall of adapter 123 so that only about ½ of the O-ring circumference protrudes beyond the peripheral wall of the upper cylindrical portion of adapter 123.

Attaching to the top hat of cap 125 and the central flange of adapter 123 is loose chain 129 which merely assures that cap 125, when removed by whatever means, remains in the proximity of the adapter 123. All pipe connections are water-tight, a proper adhesive being placed at all points of different connections.

It has also been found useful to lubricate the inside cylindrical wall of cap 125 with a silicone type lubricant; MOLYKOTE 55M Grease (MOLYKOTE is a registered trademark of Dow Corning Corporation of Midland, Mich.) has been used with success. The lubricant is not necessary for the use of the invention, however, it has been found helpful.

Continuing with FIG. 2, the cross-sectional view of the subject invention includes the sewage level sensing apparatus as follows. The added features are the elongated metal strips 151 shown interiorly to the neck of adapter 123 and pipe 107*a*, which elongated metal strips are attached to pins 153 which penetrate the sides of adapter 123 as well as coupler 121. To the outside ends of pins 153 are attached electrical wires which run to the remainder of the sewage level indicating apparatus shown in FIG. 3.

Metal strips 151 are attached to the pins 153 by any appropriate means, including threading the ends of pins 153 and then holding plates 151 onto the pins by means of threaded nuts. Any means which maintain the electrical connection and have sufficient mechanical holding ability will be satisfactory.

Referring now to FIG. 3, the electrical schematic of the sewage indicating apparatus is detailed where, proceeding from left to right, transformer T1 receives 115 volt ac electrical power by plugging into an available outlet at the residence. Thereafter, the output of the step down transformer T1 is nominally 10 volts ac which is directed to a half-wave rectifier comprising diode D1 shunted by the electrolytic capacitor C1.

The positive side of capacitor C1, being a smoothed rectified direct current voltage, is then fed to the collector of transistor Q1. The emitter of transistor Q1 is directed then to the coil T2 of a household type buzzer 175, the other lead of which is returned to the bottom side of capacitor C1. To the base and collector of transistor Q1 are attached leads which are each directed to one end of pins 153, the other ends of which are attached to the metal strips 151 previously described in FIG. 2.

The electrical portion of the invention operates when transformer T1 is activated by plugging in its primary 115 volt ac lead into a wall socket. The 10 volt ac output of transformer T1 is half-wave rectified by diode D1 to capacitor C1 which stores the electrical energy and maintains a constant dc voltage. Transistor Q1 acts as a switch which, when turned on by placing a voltage upon its base, conducts current from the collector to the emitter and through the coil T2 of the household buzzer which sounds alarm. Transistor Q1, as indicated above, conducts only when a sufficient voltage is present at its base. This sufficient voltage is determined by the water or sewage level appearing on the electrical strips 151. Thus, as sewage or water starts to rise in the coupler 107*a* an adaptor 123, voltage will begin to appear on the base of transistor Q1. As the water or sewage level continues to rise, an increased area between the two metal strips 151 will be covered so that a sufficient current will pass between the plates in order that the voltage now appearing upon the base of transistor Q1 is sufficient to pass current enough to sound buzzer T2. At that point in time, the occupant of the residence will observe the noise of the buzzer and the object of the sending an alarm will be achieved.

In operation, the relief valve which allows water to rise in the access means in order to cover metal strips 151, works as follows. Normal placement of the relief valve is accomplished exteriorly to the home plumbing at a location between the house and the street sewer system or septic tank. In the event that there is a stoppage in the sewer pipe 101 between the relief valve and the central sewage system or septic tank, sewage and water from the home will begin to back up. The air trapped therein will rise into the relief valve and when sufficient pressure of the backed up water and sewage has accumulated, cap 125 will be eased off adapter 123. The water and sewage will continue filling the shank portion of the "T" section, sound the alarm, and since the cap as already been pushed off, will proceed to flood the outside grounds until correction of the problem has been started and no new sewage is added to the line. Of course, it is anticipated that the cap 125 will reside at or near the outside ground level and that the level of the top of adapter 123 is below the level of the facilities connecting the sewer pipe interiorly to the building. While the flooding of the outside may not be entirely desirable, it is more desirable than having the sewage overflowing interiorly to the building.

In the event that the central sewer system has clogged up downstream, and water and sewage continues to flow into the sewer system upstream, again, as the sewage and water begins to rise in the sewer pipe between the central sewage system and the residence, here again, the relief valve functions. As the water and sewage rises in sewer pipe 101, the cap 125 will be popped off adapter 123 by the air trapped therein before the level has risen to flood interiorly to the house, and the sewage again is flooded onto the surrounding ground. The liquid level sensing apparatus does not impede the flow of sewage out of the relief valve. Additionally, separate means may be provided, such as a trench, to carry off any flooding waters and sewage which exit the relief valve shown in FIG. 2.

When utilizing the water or sewage level sensing apparatus shown in FIG. 2, immediately prior to sewage flooding over and onto the surrounding ground, the audible alarm of the buzzer will be sounded. The buzzer will continue to sound so long as the level of the water or sewage is adequately up upon the metal plates to conduct sufficient current thereacross. The placement of the metal strips onto the pins 153 through the side of the adaptor and coupler, rather than through the top cap 125, was for the reason that as the top cap 125 is urged off the adaptor 123, there was a possibility that the metal strips 151 would no longer be placed in position sensing the water or sewage and the alarm would cease to sound.

Figure 4:
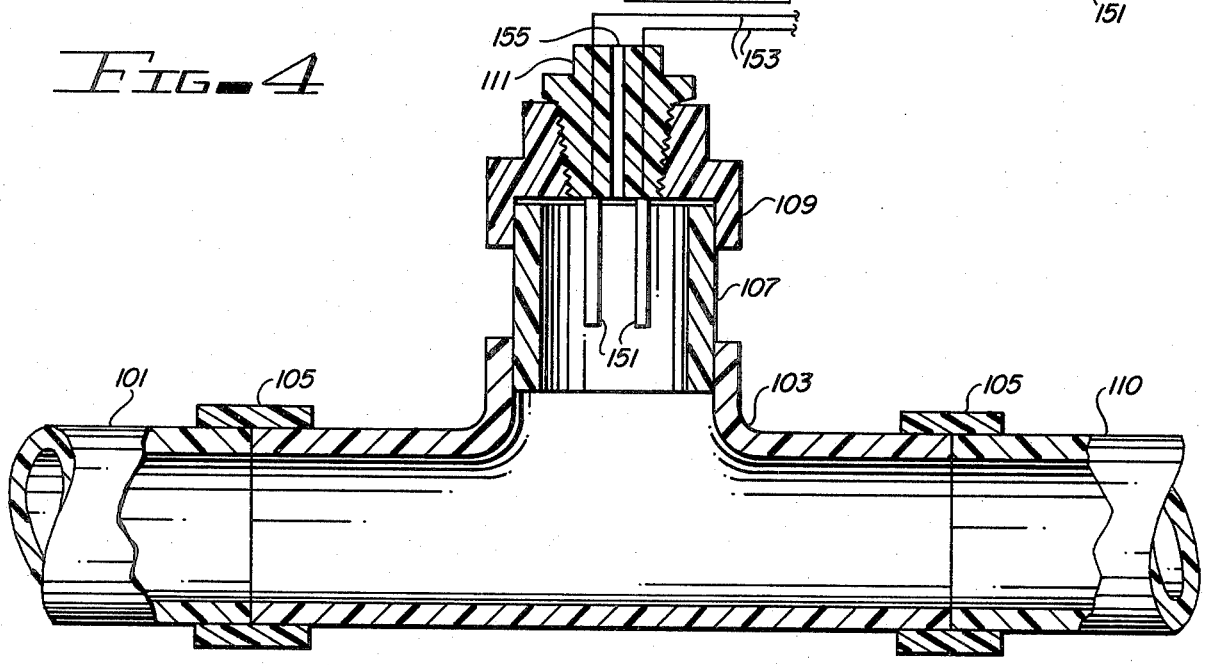
FIG. 4 is a cross-sectional view of the sewage level sensing apparatus in place in the access plug in a modified sewer line prior art.

An alternate embodiment of the invention is detailed in FIG. 4 where the sewage level sensing apparatus has been installed in the prior art access plug of a sewer line. More specifically, pins 153 now penetrate plastic plug 111 where they are joined at their interior end by metal strips 151. The opposite ends of pins 153 connect to the transistor Q1 base and collector as shown in FIG. 3. In addition, a vent hole 155 centrally located in plug 111 penetrates plug 111 and communicates with the interior portion of the sewer line. With such a vent hole, the sewage may rise in the access in the process of overflowing, although very little would escape. Once the sewage has reached an appropriate level on metal strips 151, the alarm is sounded. This has been previously discussed in connection with FIGS. 2 and 3 and the principle remains the same.

Figure 5:
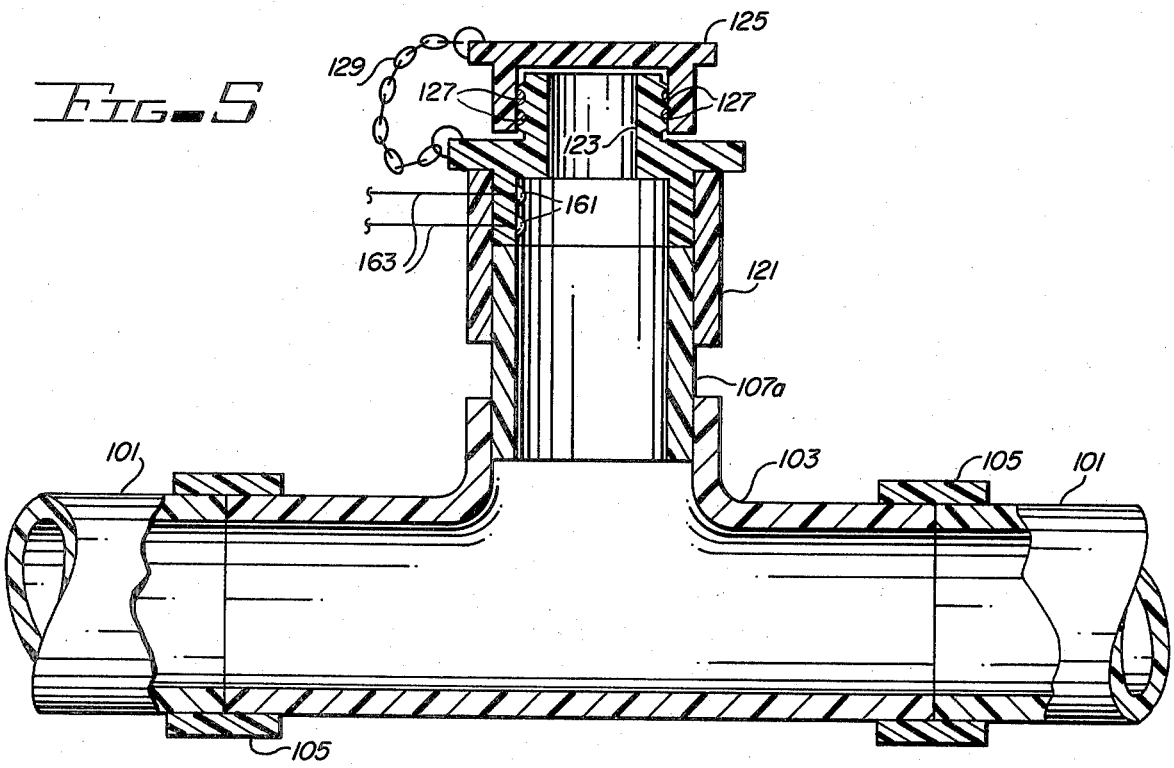
FIG. 5 is a cross-sectional view of an alternate embodiment of the subject invention in place in a sewer line.

A further alternate embodiment of the invention is detailed in FIG. 5 where a differently constructed sewage level sensing apparatus has been placed in the apparatus of FIG. 2, now shown in FIG. 5. Here (FIG. 2) the metal strips 151 attached to pins 153 have been replaced with metal non-touching buttons 161 which attach to the interior wall of adaptor 123 and connect to electrical wires or pins 163. The size and the amount of protrusion of the buttons are exaggerated in FIG. 5 for illustrative purposes. The buttons may be placed one on top of another, as shown in FIG. 5, or they be placed side by side, at an equal height, in the adapter. It is suggested that the buttons reside under the lip formed by the upper portion of adapter 123. The size of the button may vary as desired, the only requirement that if a rather small button be employed, a high gain transistor Q1 may be necessary in the circuit of FIG. 3.

In the preferred embodiment, plastic sewage pipe has been utilized, although, of course, other types of pipes and parts may be used, not excluding metal. It is realized, of course, the cap 125 shall not weigh an excessive amount, as it must be removed by air and water pressure of the water rising in "T" and relief valve section.

For ease of manufacture from present existing plumbing supplies, in the preferred embodiment, the cap 125 was constructed from a four-inch female type plug, where the interior converging threads were machined on a lathe to present a smooth constant diameter cylindrical surface. Further, the adapter 123, which has some similarity to the adapter 109 illustrated in FIG. 1, had the interior converting threads in the upper cylinder machined to a constant diameter smooth interior wall. Fabrication from existing parts is not necessary for the invention as it is plain the parts can be assembled or prepared from raw materials, such as molding from dies.

The sewage level sensing apparatus comprises readily available components, the step down transformer T1 and buzzer T2 being that variety that's commonly available for home doorbells, diode D1 being a low voltage, medium current diode commonly available, transistor Q1 beng General Electric transistor GE72, and capacitor C1 being a 10,000 microfarads electrolytic capacitor. The elongated plates were constructed from ½ inch by 3¾ inch brass strips and pins 151 are copper rods. In practice, it has been determined that the electrical circuit functions to turn buzzer T2 on when approximately 2 and ½ inches of elongated plates are covered with water.

While a preferred embodiment of the invention has been shown and described, it is appreciated that the scope of the invention is not to be limited except as defined in the appended claims.

I claim:

1. An apparatus for sensing the pressure of sewage backup conditions in a sewer system, said apparatus comprising in combination:

(a) connecting means having an interior region and first and second openings into said interior region, said connecting means being connected in sealed relationship with a sewer pipe so that there is a continuous channel from the interior of said sewer pipe through said first opening into said interior region, whereby backed up sewage can flow from said sewer pipe into said interior region;

(b) pop-off covering means engaging said connecting means and responsive to pressure in said interior region caused by backing up of sewage in said sewage pipe for covering said second opening when the pressure in said interior chamber is low and popping off of said connecting means when said sewage backs up in said sewage pipe;

(c) sealing means for sealable engagement with both said pop-off covering means and a portion of said connecting means surrounding said second opening to effect an air-tight, waterproof connection of said pop-off covering means with said connecting means until the pressure due to sewage backup in said interior region reaches a predetermined level;

(d) first and second electrical conducting means extending into said interior region from outside of said connecting means for making electrical contact with sewage backed up into said interior region, whereby a reduced electrical resistance between said first and second electrical conducting means is produced as a result of said electrical contact with said backed up sewage; and (e) electrical alarm means coupled to said first and second electrical conducting means for producing an alarm signal indicating the presence of said backed up sewage in said interior region.

2. The apparatus of claim 1 wherein said electrical alarm means includes an audible buzzer that produces an audible alarm sound in response to said alarm signal.

3. The apparatus of claim 1 wherein said portion of said connecting means surrounding said second opening includes a groove surrounding said second opening, said sealing means includes a flexible O-ring disposed in said groove, and said pop-off covering means includes a cap having a surface engaging said O-ring to provide said air-tight, waterproof relationship.

* * * * *